US005722655A

United States Patent [19]

Reist

[11] Patent Number: 5,722,655

[45] Date of Patent: Mar. 3, 1998

[54] APPARATUS FOR EVENLY SPACING SUCCESSIVE PRINTED PRODUCTS

[75] Inventor: Walter Reist, Hinwil, Switzerland

[73] Assignee: Ferag AG, Hinwil, Switzerland

[21] Appl. No.: 853,193

[22] Filed: May 8, 1997

Related U.S. Application Data

[63] Continuation of Ser. No. 599,098, Feb. 7, 1996, abandoned.

[30] Foreign Application Priority Data

Feb. 16, 1995 [CH] Switzerland ..... 00 450/95

[51] Int. Cl.[6] ..... B65H 5/34

[52] U.S. Cl. ..... 271/270; 271/272; 271/275; 271/186; 271/198; 271/202; 271/216; 271/176; 198/812

[58] Field of Search ..... 271/186, 191, 271/176, 198–200, 202, 204, 214–216, 270, 272–274; 198/604, 607, 812, 626.5, 594

[56] References Cited

U.S. PATENT DOCUMENTS

| | | | |
|---|---|---|---|
| 3,565,423 | 2/1971 | Kluth | 271/202 X |
| 3,650,527 | 3/1972 | Helm | 271/202 |
| 3,911,800 | 10/1975 | Felkamper | 271/202 X |
| 4,320,894 | 3/1982 | Reist et al. . | |
| 4,718,656 | 1/1988 | Reist . | |
| 4,805,890 | 2/1989 | Martin | 271/216 X |
| 5,158,278 | 10/1992 | Auf der Mauer . | |
| 5,244,201 | 9/1993 | Balcerek et al. | 271/202 |
| 5,443,254 | 8/1995 | Reist . | |
| 5,503,264 | 4/1996 | Eberle . | |

FOREIGN PATENT DOCUMENTS

| | | | |
|---|---|---|---|
| 259 650 | 11/1991 | European Pat. Off. . | |
| 568883 | 11/1993 | European Pat. Off. | 271/199 |
| 23 07 728 | 9/1974 | Germany . | |
| 101548 | 8/1980 | Japan | 271/200 |
| 2074990 | 11/1981 | United Kingdom | 271/198 |

*Primary Examiner*—Boris Milef
*Attorney, Agent, or Firm*—Bell Seltzer Intellectual Property Law Group of Alston & Bird LLP

[57] ABSTRACT

Sheet-like products are fed to the transfer location by a first conveyor. A detector arrangement determines the spacing between the products and controls the first predetermined speed of a second conveyor correspondingly, with the result that, at the transfer location, the formation of the products have a predefined spacing. If the second conveyor is driven, at the stationary transfer location, at the first predetermined speed which differs from a second predetermined speed at the stationary discharge location, the conveying length of the second conveyor changes, thereby displacing a deflection wheel. Different spacings between fed products can thus be evened out.

10 Claims, 5 Drawing Sheets

APPARATUS FOR EVENLY SPACING SUCCESSIVE PRINTED PRODUCTS

This application is a continuation of application Ser. No. 08/599,098, filed Feb. 7, 1996, and now abandoned.

FIELD OF THE INVENTION

The present invention relates to an apparatus for evenly spacing successive sheet-like products, such as printed products.

BACKGROUND OF THE INVENTION

An apparatus of this general type is set forth in EP-A-O259650. According to that application, a first conveyor transports the printed products which are arranged in an imbricated formation to a transfer location where they are deposited onto a second conveyor. The printed products remain in an imbricated formation, but with a predetermined spacing between the leading edges of the printed products. The second conveyor is driven continuously at a speed which is approximately half the speed of the first conveyor whereby the spacing between the printed products in the imbricated formation is smaller than in the fed imbricated formation. If a detector arrangement, positioned adjacent the first conveyor, detects a gap, i.e. one or more missing printed products, in the fed imbricated formation, the transfer location is displaced in the conveying direction to increase the conveying length of the first conveyor and simultaneously reduce, to the same extent, the conveying length of the second conveyor. This occurs when the product directly preceding the gap has been deposited on the second conveyor and continues until the first printed product following the gap reaches the transfer location. As soon as this printed product has been deposited on the preceding printed product, the transfer location is slowly moved back, counter to the conveying direction, to the initial position. Since the second conveyor has to be driven at a lower speed than the first conveyor, the spacing between successive printed products is always reduced to a predetermined magnitude at the transfer location. This occurs even if the printed products fed to the transfer location are at the correct spacing for further processing. This means that the second conveyor has to have provided downstream of it a device for increasing the spacing between the printed products an amount necessary for further processing.

SUMMARY OF THE INVENTION

The object of the present invention is thus to provide an apparatus which makes it possible, at the transfer location, for the printed products to be arranged on the second conveyor with the spacing desired for further processing.

This object is achieved by an apparatus according to the present invention for evenly spacing successive sheet-like products having a first and second conveyor. The first conveyor is for feeding products to a transfer location and the second conveyor is positioned downstream of the first conveyor. At a transfer location, the products are transferred from the first conveyor while being arranged in a predetermined formation with a predetermined spacing between mutually corresponding edges of successive products. The second conveyor is positioned for transporting the products, unchanged in position with respect to one another, to a discharge location. The apparatus also includes a detector arrangement which is positioned upstream of the transfer location, as seen in a conveying direction, for detecting spacing between corresponding edges of the products transported by the first conveyor. The transfer location is arranged first in a stationary manner and the second conveyor includes a first predetermined speed at the transfer location. Between the transfer location and the discharge location is an effective conveying length. The first speed is controlled as a function of signals of the detector arrangement and the effective conveying length of the second conveyor can be changed as a function of the first speed. There is a second predetermined speed of the second conveyor at the discharge location which is controlled as a function of the first predetermined speed of the second conveyor at the transfer location.

Since, according to the present invention, the speed of the second conveyor at the stationary transfer location is controlled as a function of signals of the detector arrangement, i.e. of the spacing between successive products fed to the transfer location, the products are arranged, at the transfer location, on the second conveyor at a predetermined spacing. The change, according to the invention, in the effective conveying length of the second conveyor as a function of the speed at the transfer location and the speed of the second conveyor at its discharge location isolates the transfer from the discharge wherein, at the transfer location, the second conveyor may be driven at a speed which differs from that at the discharge location to even out the spacings between the products. This makes it possible for the printed products to be transported from the transfer location to the discharge location with unchanged spacing between successive products.

The apparatus according to the invention makes it possible not only for gaps in a product stream fed to the transfer location to be closed, but also for the spacing between successive products to be increased to the predetermined magnitude in the event of products being fed in piled-up form, in the manner of a compacted formation section, to the second conveyor by means of the first conveyor.

BRIEF DESCRIPTION OF THE DRAWINGS

The present invention will now be described in detail with reference to an exemplary embodiment represented in the drawing, in which, schematically.

DETAILED DESCRIPTION OF THE DRAWINGS

Figure 1:
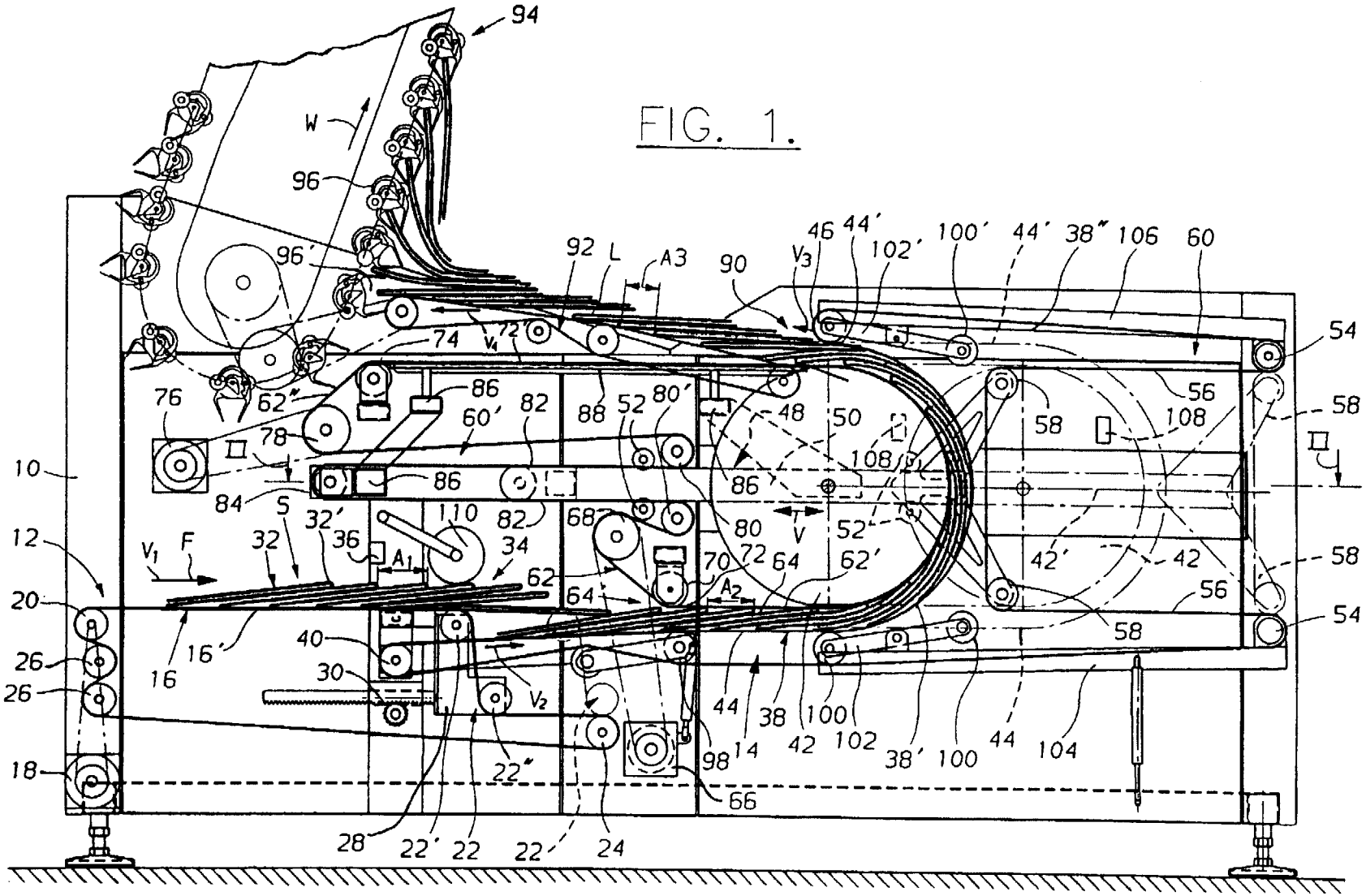
FIG. 1 is an elevational view of an apparatus according to the present invention for evenly spacing successive sheet-like products at a transfer location from a first to a second conveyor, wherein the apparatus also permits gaps to be formed at the discharge location of the second conveyor.
Figure 2:
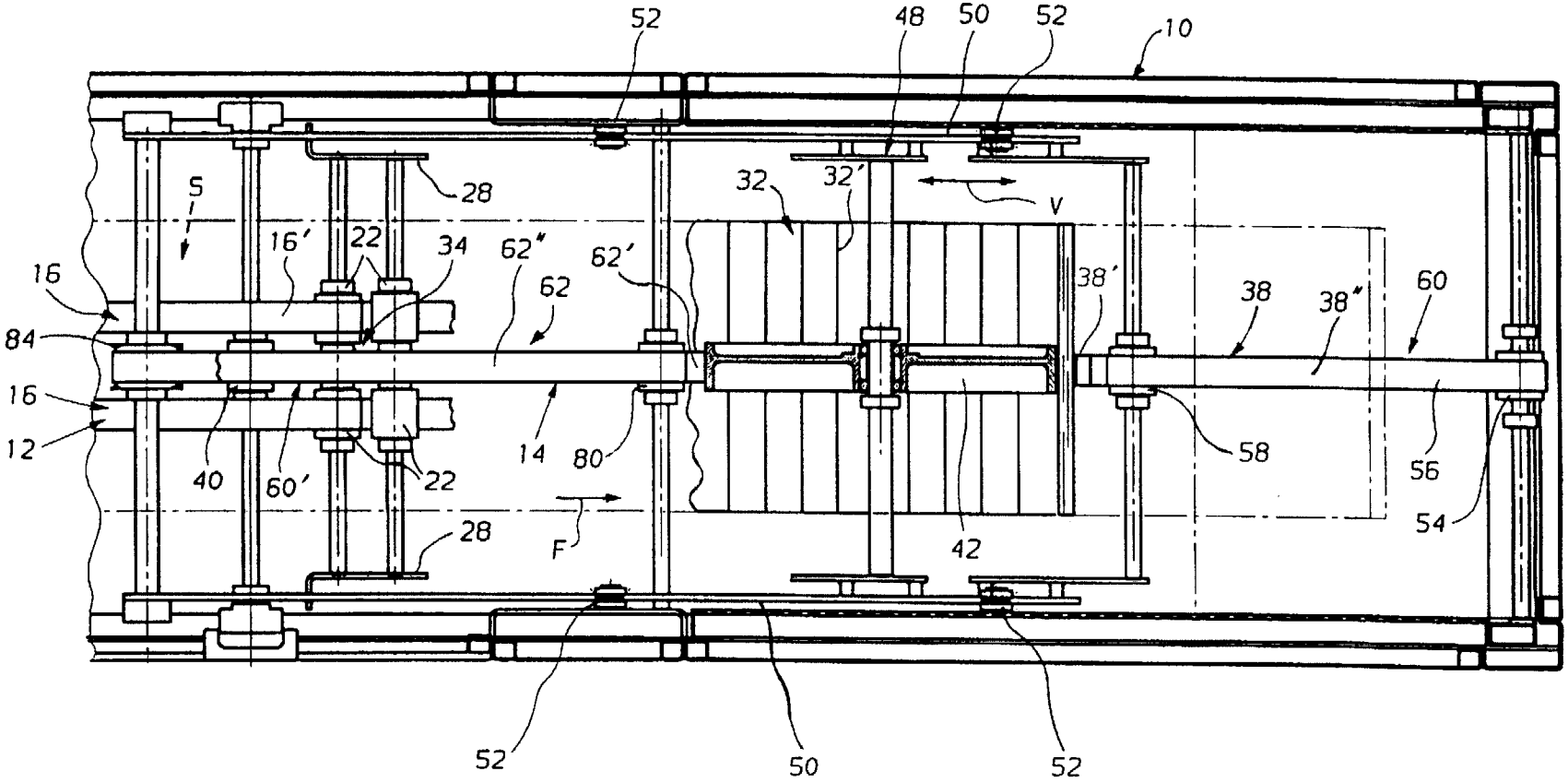
FIG. 2 is a cross-sectional view taken at line II—II of FIG. 1 through part of the apparatus illustrated in FIG. 1.

The apparatus shown in FIGS. 1 and 2 includes a machine framework 10 on which there are arranged a first conveyor 12, designed as a belt conveyor and driven at a speed v1 in the conveying direction F, and a second conveyor 14, which is provided downstream of the first conveyor and is likewise designed as a belt conveyor.

The first conveyor 12 includes two parallel endless belts 16 which are guided around rollers mounted equiaxially. The belts 16 run to a stepped-roller pair 22 from drive rollers 20 mounted on the machine framework 10 at the beginning of the first conveyor 12, as seen in the conveying direction F. The belts 16 are connected to a motor 18 and are guided around the upper and lower rollers 22',22" of the stepped-roller pair 22 in a downwardly directed step. The section of the belts 16 between the drive rollers 20 and the upper roller 22' forms the conveying strand 16'. The belts 16 run from the stepped-roller pair 22, parallel to the active strand 16', to belt rollers 24, mounted in a stationary manner on the machine framework 10 downstream of the stepped-roller pair, as seen in the conveying direction F. The belts 16 extend back to the drive rollers 20 from the belt rollers 24 and the belts 16 are guided in the form of an S around further belt rollers 26 to better grasp the drive rollers 20. The stepped-roller pair 22 is arranged on a bearing plate 28 which, by means of a rack gear mechanism 30, can be moved, in and counter to the direction of the active strand 16', into a desired position where it may be fixed. This is done to adjust the apparatus, to conform with the length, measured in the conveying direction F, of the sheet-like products 32 which are to be processed. In the present case, these products 32 are printed products, such as newspapers, periodicals and the like. They are fed to a transfer location 34, the positioning of which is determined by the stepped-roller pair 22, by means of the first conveyor 12 in an imbricated-type formation S wherein each product 32 bears on the preceding product, as seen in the conveying direction F.

Positioned above the active strand 16' on the machine framework 10 is a detector arrangement 36 which senses the leading edges 32', seen in the conveying direction F, of the products 32. Taking into account the speed v1, the detector arrangement 36 determines the spacing between the leading edges 32' of successive products 32 and emits corresponding control signals.

As shown particularly in FIG. 2, the second conveyor 14 includes an endless conveying belt 38 which is guided around a first deflection roller 40. The deflection roller 40 is mounted in a stationary manner on the machine framework 10 beneath the active strand 16' of the first conveyor 12 and upstream with respect to the stepped-roller pair 22. From the deflection roller 40, the conveying belt 38 runs, with a first belt section 44, approximately parallel to the active strand 16' to the bottom of a deflection wheel 42, wherein it is wrapped approximately 180°, and runs, with a second belt section 44', from the deflection wheel to a second deflection roller 46. The first belt section 44 runs in a crosswise manner between that section of the belts 16 which extends between the stepped rollers 22 wherein the product 32 which is conveyed to the transfer location 34 by the first conveyor 12 drops on to the belt section 44. The region of the conveying belt 38 between the transfer location 34 and the second deflection roller 46 forms the conveying strand 38' of the conveying belt. This constitutes the active conveying length of the second conveyor 14.

The deflection wheel 42 is mounted in a freely rotatable manner on a frame-like carrying element 48 which, by means of its lateral longitudinal carriers 50, is guided on roller pairs 52, mounted in a stationary manner on the machine framework 10, such that it can be moved back and forth freely in the direction of the double arrow V. The movement direction of the carrying element 48, and thus of the deflection wheel 42, is shown in phantom as the movement path 42' and runs essentially parallel to the belt sections 44 and 44'. The length of the belt sections 44, 44' depends on the position of the deflection wheel 42. In FIG. 1, a first end position of the carrying element 48, and thus of the deflection wheel 42, is indicated by solid lines and a second end position thereof is indicated by chain-dotted lines.

The return strand 38" of the conveying belt 38 runs from the first deflection roller 40 and the second deflection roller 46 to the further deflection rollers 54 which are mounted in a stationary manner on the machine framework 10. The return strand 38 further extends around the further deflection rollers 54 and, with a further belt section 56 running parallel to the first and second belt sections 44, 44', to deflection rollers 58 mounted on the carrying element 48. A lengthening of the first and second belt sections 44, 44' thus necessarily entails a shortening, to the same extent, of the further belt sections 56 and vice versa, resulting in a change in length of the conveying strand 38' which is automatically compensated for upon displacement of the carrying element 48. The deflection of the return strand 38" around the further deflection rollers 54 and the deflection rollers 58, fixed to the carrying element, in the manner shown in FIG. 1, forms a length-compensation device 60 for changing the conveying length of the second conveyor 14.

Furthermore, the second conveyor 14 includes an endless transporting belt 62 which forms, together with the conveying belt 38, a conveying nip 64 for the products 32. It is guided around a drive roller 68, mounted in a stationary manner on the machine framework, above the first belt section 44 and is connected to a first drive motor 66. The transporting belt 62 extends from the drive roller to a first guide roller 70, arranged in a stationary manner on the machine framework 10 between the transfer location 34 and the deflection wheel 42. This thereby forms, together with the first belt section 44, a tapering inlet 64' into the conveying nip 64. From the guide roller 70, a first section 72 of the transporting strand 62' of the transporting belt 62 leads to the bottom of the deflection wheel 42. As seen in the conveying direction F, the conveying strand 62', adjoining the first section 72 wraps around the deflection wheel 42 through approximately 180° and extends, with a second section 72', to a second guide roller 74, mounted in a stationary manner on the machine framework 10.

As can be seen particularly in FIG. 1, the transporting strand 62' of the transporting belt 62 rests directly against the deflection wheel 42 as it is deflected around the same. The conveying strand 38' of the conveying belt 38, however, wraps around the deflection wheel 42 outside the transporting belt 62, as seen in the radial direction. The first and second sections 72 and 72' run parallel to the first and second belt sections 44, 44' and thus parallel to the displacement direction V of the deflection wheel 42.

Following the second guide roller 74, seen in the conveying direction F, the transporting belt 62 is guided around a second drive roller 78, connected to a second drive motor 76 and mounted in a stationary manner on the machine framework 10. The transporting belt 62 then extends from the drive roller 78, in the direction counter to the second belt section 72', to a further guide roller 80, which is also mounted in a stationary manner on the machine framework 10. Correspondingly, the transporting belt 62 runs from the first drive roller 68, on the side remote from the first guide roller 70, to a further guide roller 80', which is also fixed to the machine framework. From the two further guide rollers 80, 80', the transporting belt 62 extends with a further section 82 at least approximately parallel to the first and second sections 72, 72', to a further deflection roller 84, mounted in a freely rotatable manner on the carrying element 48. The S-shaped guidance of the return strand 62" of the transporting belt 62 is defined by the second guide roller 74, the second drive roller 78 and further guide roller 80 to the deflection roller 84. From the deflection roller 84, the return strand 62" extends around the associated further guide roller 80'. The first drive roller 68 and first guide roller 70 form a length-compensation device 60', in which a lengthening of the first and second sections 72, 72' is automatically compensated for by a shortening of the sections 82, and vice versa, upon displacement of the deflection wheel 42'.

The longitudinal carriers 50 of the carrying element 48 are connected to one another via transverse carriers 86, on which there is arranged a supporting plate 88. The second section 72' of the transporting belt 62 extends over the supporting plate 88 and serves to support the transporting belt 62 and the products 32 when the carrying element 48 is not located in the left-hand end position as shown by solid lines in FIG. 1. The stationary discharge location 90 of the second conveyor 14 is located at the second deflection roller 46.

Adjoining the second conveyor 14, in the conveying direction F, at the discharge location 90, is a third conveyor 92. The third conveyor 92 is likewise designed as a belt conveyor and is connected for drive operation to a removal conveyor 94. The removal conveyor 94 runs beyond the end of the third conveyor 92 with a removal direction W running from bottom to top. It is designed as a clamp-type conveyor and is intended, by means of each of its individually controlled clamps 96, for seizing a product 32 introduced into the open clamp mouth 96' by the third conveyor 92, and for removing the product in the upwards direction. The construction and mode of functioning of removal conveyors 94 of this type and their interaction with the third conveyor 92 are known, for example, from CH-A-630583 and the corresponding U.S. Pat. No. 4,320,894, and EP-A-0633212 and the corresponding U.S. Pat. No. 5,503,264, each of which is incorporated herein by reference.

The conveying belt 38 and the transporting belt 62 are connected to one another for drive operation either via the products 32 located in the conveying nip 64 or, if no products are present, by resting directly against one another. It is therefore sufficient if only the conveying belt 38 or the transporting belt 62 is driven. The first drive motor 66 thus determines the speed v2 of the second conveyor 14 at the transfer location 34. In a corresponding manner, the second drive motor 76 determines the speed v3 of the second conveyor at the discharge location 90. Different speeds v2, v3 of the second conveyor 14 at the transfer location 34 and discharge location 90 result in a change in the effective conveying length of the second conveyor 14, which entails a displacement of the deflection wheel 42. The first drive motor 66 is activated by the control signals of the detector arrangement 36, and speed v2 is thus determined by the products 32 which are present. In contrast, the speed of the second drive motor 76 is dependent upon the third conveyor 92. The speed of the third conveyor 92 is designated by v4.

The conveying strand 38' of the conveying belt 38 is guided over a pressing-on roller 98 which is arranged beneath the first guide roller 70 and which is upwardly biased for pressing the conveying belt 38 in the direction of the transporting belt 62 so that the products 32 introduced into the inlet 64' may be grasped for entrainment in the conveying nip 64.

Further pressing-on rollers 100, likewise intended for interaction with the conveying strand 38', are mounted on a two-armed lever 102 which is mounted pivotably on a rocker 104 which is upwardly biased. The rocker 104 is mounted on the spindle for the lower further deflection roller 54 for forcing the further pressing on rollers 100 upward to support the conveying strand 38' and thus to retain the products 32 securely in the conveying nip 64. If no products 32 are present, the rocker 104 retains the conveying belt 38 such that it rests against the transporting belt 62. In a corresponding manner, the second deflection roller 46 and a further pressing-on roller 100' are mounted on a lever 102' which is arranged on a weighting lever 106. The weighting lever 106 is mounted on the spindle bearing the upper further deflection roller 54.

Position indicators 108, which are connected to a higher-order control means and are arranged on the machine framework 10, are also provided. The indicators 108 are intended for emitting a signal to the higher-order control means when the carrying element 48 is located in the end positions. In this case, depending on the mode of operation, the feeding of products 32 to the apparatus shown in FIGS. 1 and 2 or to the removal conveyor 94 has to be stopped temporarily until the carrying element 48 is located in an appropriate position.

In FIG. 1, the products 32 located in the region of the first conveyor 12 are arranged in an imbricated formation S in which each product 32 bears on the preceding product, the spacing, designated by A1, between the leading edges 32' of successive products 32 being of the same magnitude. Printed products 32 arranged in an imbricated formation S are shown in the region of the second conveyor 14. The spacing here between the leading edges 32' of successive products 32, designated by A2, corresponds to the spacing A1. In the region of the first belt section 44, each printed product 32 again bears on the preceding product, whereas, as a result of the deflection of the imbricated formation S around the deflection wheel 42, each product 32 then bears on the following product in the region of the second belt section 44'. However, the mutual position of the products 32 does not change in the region of the second conveyor 14.

Products 32 are likewise shown in an imbricated formation in the range of action of the third conveyor 92. The imbricated formation corresponds to the formation in the region of the second belt section 44' of the second conveyor 14. The spacing here, designated by A3, between the leading edges 32' of successive products 32 corresponds to the spacing A2. It should be noted that a product 32 is missing in the imbricated formation S located on the third conveyor 92. This gap is indicated by L.

FIGS. 3 to 8 illustrate the operation of the apparatus shown in FIGS. 1 and 2. FIGS. 3 to 6 show, schematically, portions of the first conveyor 12 and the second conveyor 14. The references indicated in the Figures designate the same elements in FIGS. 1 and 2. As to the first conveyor 12, part of a belt 16, which is guided around the upper roller 22' of the stepped-roller pair 22, is shown. The detector arrangement 36 is located above the active strand 16'. Located likewise above the active strand 16' and adjacent to the depicted upper roller 22' is the weighting roller 110, which is arranged on a freely pivotably mounted lever.

As to the second conveyor 14, the deflection wheel 42 and part of the conveying belt 38, and the transporting belt 62, guided around the wheel are shown. Likewise indicated is the second deflection roller 46, defining the stationary discharge location 90 for the conveying belt 38 and the first drive roller 68 for the transporting belt 62 and the stationary first guide roller 70, which determines the start of the conveying nip 64. The first 44 and second 44' belt sections of the conveying belt 38 are longer or shorter depending on the position of the deflection wheel 42. Reference elements 72 and 72' designate the corresponding sections of the transporting belt 62.

Figure 3:
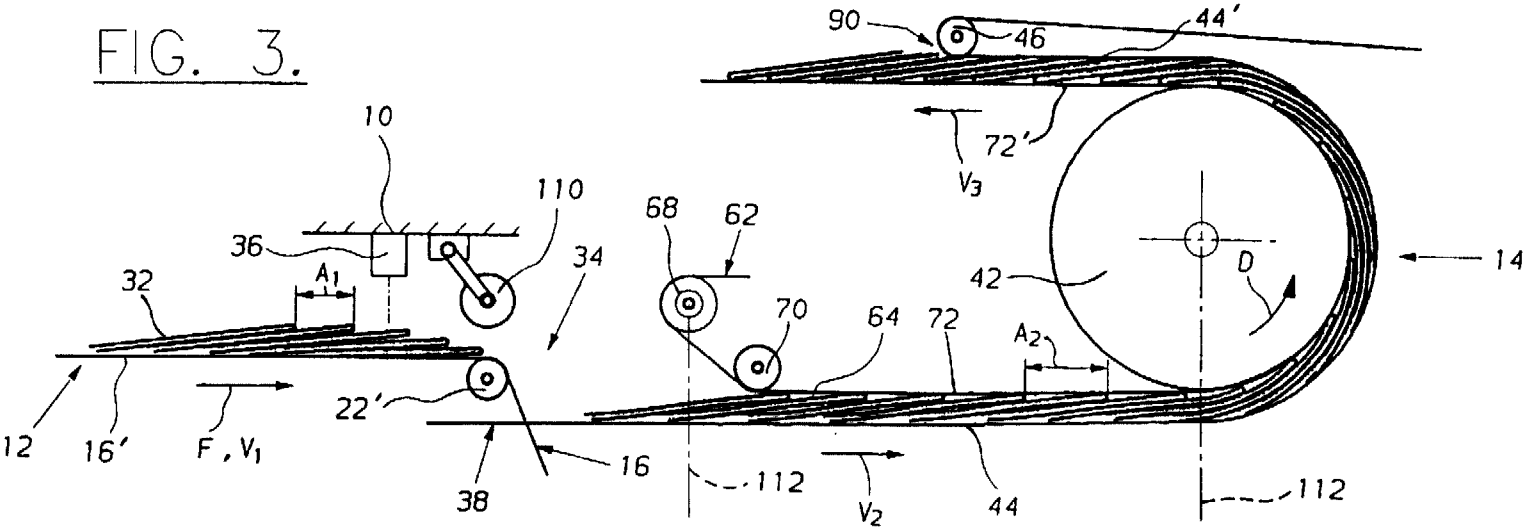
FIGS. 3 and 4 are elevational views of a portion of the apparatus shown in FIGS. 1 and 2 at two different points in time during the closure of a gap in an imbricated stream.
Figure 4:
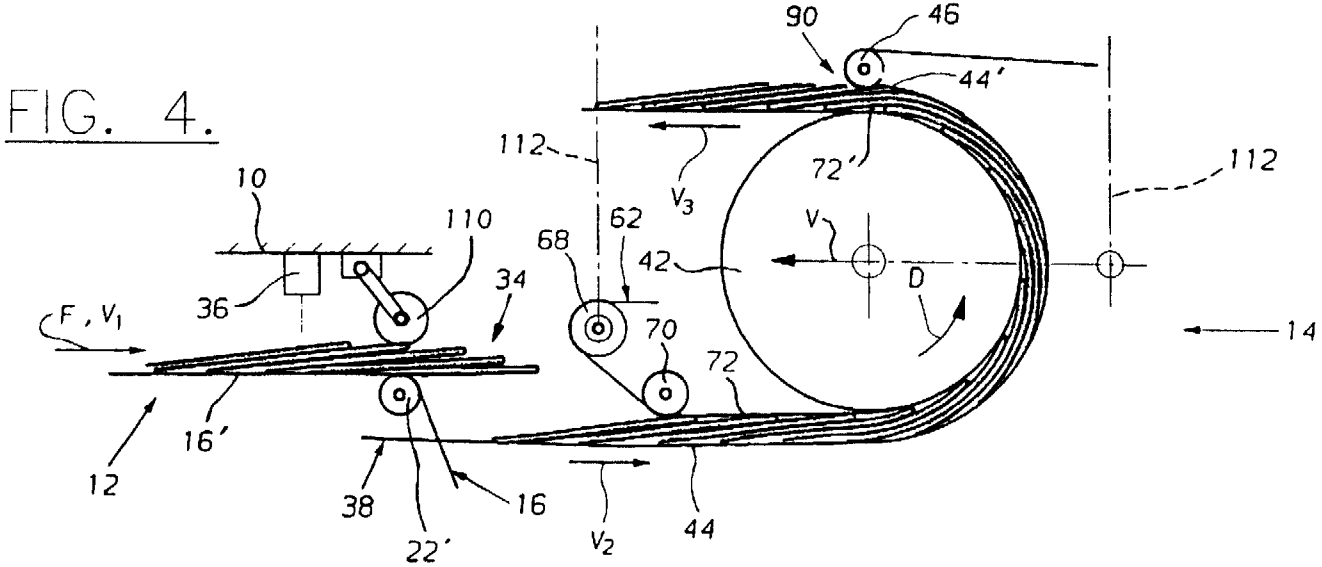

In relation to FIGS. 3 and 4, chain-dotted lines 112 indicate the stationary arrangement of the transfer location 34 and the changeable position of the deflection wheel 42. A straight reference line 112 shown in FIGS. 5 and 6 indicates the stationary discharge location 90. The different positioning of the deflection wheel 42 is shown.

Figure 7:
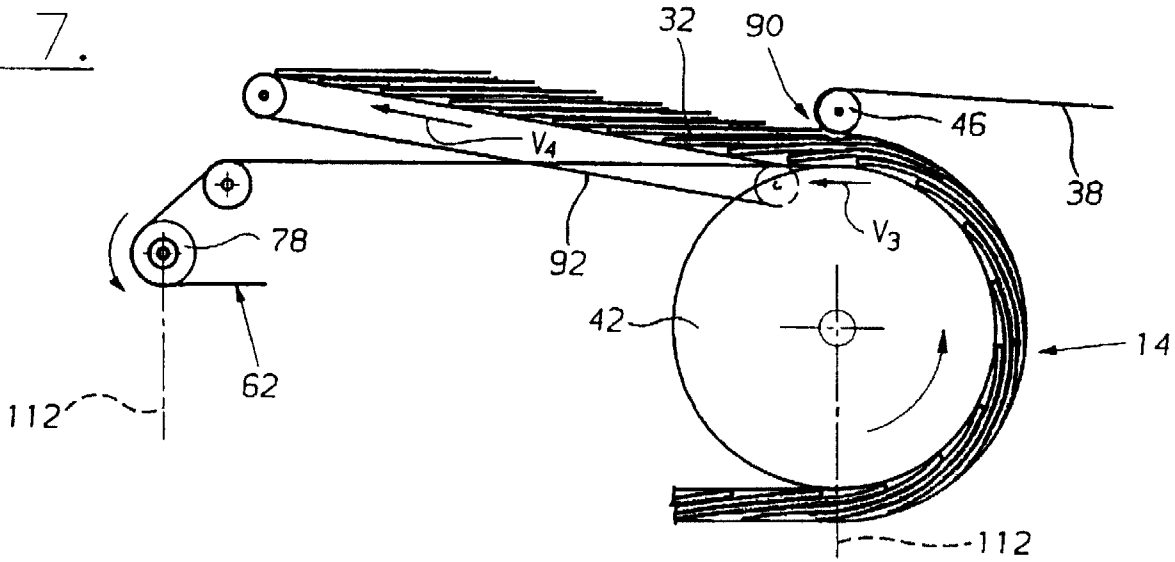
FIGS. 7 and 8 are elevational views of portions of the apparatus shown in FIGS. 1 and 2, during and after the formation of a gap in an imbricated formation.
Figure 8:
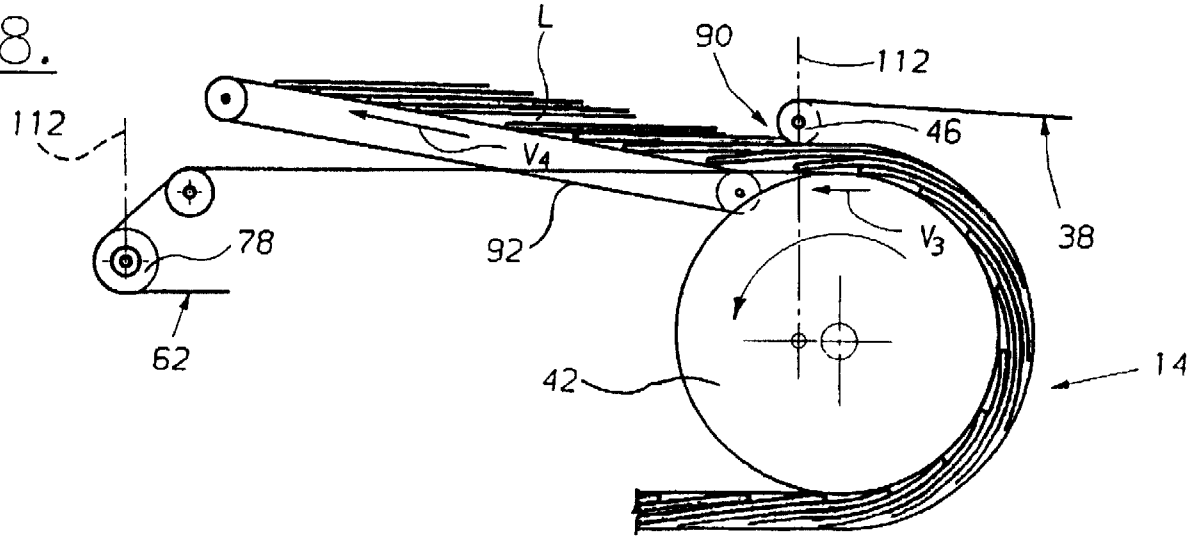

The deflection wheel 42, part of the conveying belt 38, and part of the transporting belt 62 are shown in FIGS. 7 and 8. The second deflection roller 46 once again establishes the discharge location 90 of the second conveyor 14. Further indicated is the second drive roller 78 for the transporting belt 62. The straight reference line 112 running through the second drive roller 78 illustrates the stationary arrangement of the drive roller. The straight reference line 112 shown on the right-hand side once again illustrates the different positioning of the deflection wheel 42. The third conveyor 92, to which the products 32 are transferred from the second conveyor 14 at the discharge location 90, is also shown.

To ensure a reliable transfer of the printed products 32 from the first conveyor 12 to the second conveyor 14, the spacing between the first guide roller 70, i.e. the beginning of the conveying nip 64, and the upper rollers 22' is set, before the start of the feed of printed products 32, by means of the rack gear mechanism 30 in accordance with the size of the products 32 to be processed. If large products, as measured in the conveying direction F, are to be processed, the spacing is correspondingly large and, if small products 32 are to be processed, the spacing is correspondingly small, as is shown by the stepped-roller pair 22 indicated by chain-dotted lines. During the processing of the products 32, however, the position of the stepped-roller pair 22 remains fixed, as a result of which the transfer location 34 is also stationary.

Advantageously, at the start of processing, the carrying element 48, and thus the deflection wheel 42, is located approximately centrally between the two end positions shown in FIG. 1. If the second drive motor 76 is stopped and the first drive motor 66 drives the second conveyor 14 in the conveying direction F at the transfer location 34, the carrying element 48, as a result of the depicted type of guidance of the transporting belt 62, moves to the right due to the shortening, between the two drive motors 66, 76, of that section of the transporting belt 62 which is guided around the further guide rollers 80, 80' and the deflection roller 84, this being associated with an increase in the conveying length of the second conveyor 14. If the carrying element 48 is to be displaced to the left, the first drive motor 66 is stopped and the second drive motor 76 is activated, with the result that it drives the second conveyor 14 in the conveying direction F at the discharge location 90. As a result of a shortening between the drive motors 66, 76, of that section of the transporting belt 62 which is guided around the deflection wheel 42, there is associated therewith a reduction in the conveying length of the second conveyor 14.

If, as shown in FIG. 1, the products 32 are present in the form of a formation S in which the spacing A1 corresponds to the spacing A2 necessary for further processing, the second conveyor 14 is driven, at the transfer location 34, by means of the motor 66 at a speed v2 which corresponds to the speed v1 of the first conveyor 12. Consequently, the products 32 assume, in the imbricated formation S formed on the second conveyor 14, the same mutual position which they assumed in the imbricated formation in the region of the first conveyor 12. If the products 32 can be removed continuously, by means of the third conveyor 92 and the removal conveyor 94, with the same timing as that with which they were provided on the first conveyor, the second conveyor 14 is driven at the discharge location 90 by the second drive motor 76 at a speed v3 which is equal to the speeds v1 and v2. The conveying length of the second conveyor 14, and thus the position of the carrying element 48, remains unchanged.

If, however, one or more products 32 are missing from the fed imbricated formation on the first conveyor 12, this is detected by the detector arrangement 36. The second conveyor 14 then continues to be driven by means of the first drive motor 66 such that its speed v2 at the transfer location 34 is equal to the speed v1 of the first conveyor 12, until the product 32 immediately preceding the gap has been transferred to the second conveyor 14. Then, by stopping the first drive motor 66, the speed v2 is brought to zero, which is the case in FIG. 3. The first conveyor 12 continues to run with unchanged speed v1 and, controlled by the detector arrangement 36, the first drive motor 66 is brought into operation again in order, once again, to drive the second conveyor 14, at the transfer location 34, at the same speed as the first conveyor 12 as soon as the first product 32 following the gap has been fed to the second conveyor 14 in the correct position. FIG. 4 shows the situation shortly before the gap is closed and the first drive motor 66 is brought into operation again.

If, while the second conveyor 14 is at a standstill at the transfer location 34, products 32 are transferred to the third conveyor 92 with unchanged speed v3 at the discharge location 90, the conveying length of the second conveyor 14 is shortened, the deflection wheel 42 being displaced to the left, as can be seen from comparing FIGS. 3 and 4 and as is indicated in FIG. 4 by means of an arrow V pointing to the left. The anti-clockwise arrows D indicate that, during this, the deflection wheel 42 continues to rotate, but only at half-speed with respect to the steady state. After the gap has been closed, the steady state is reached once again and the conveying length of the second conveyor 14 again remains unchanged until the next irregularity in the fed imbricated formation S has to be compensated.

Figure 5:
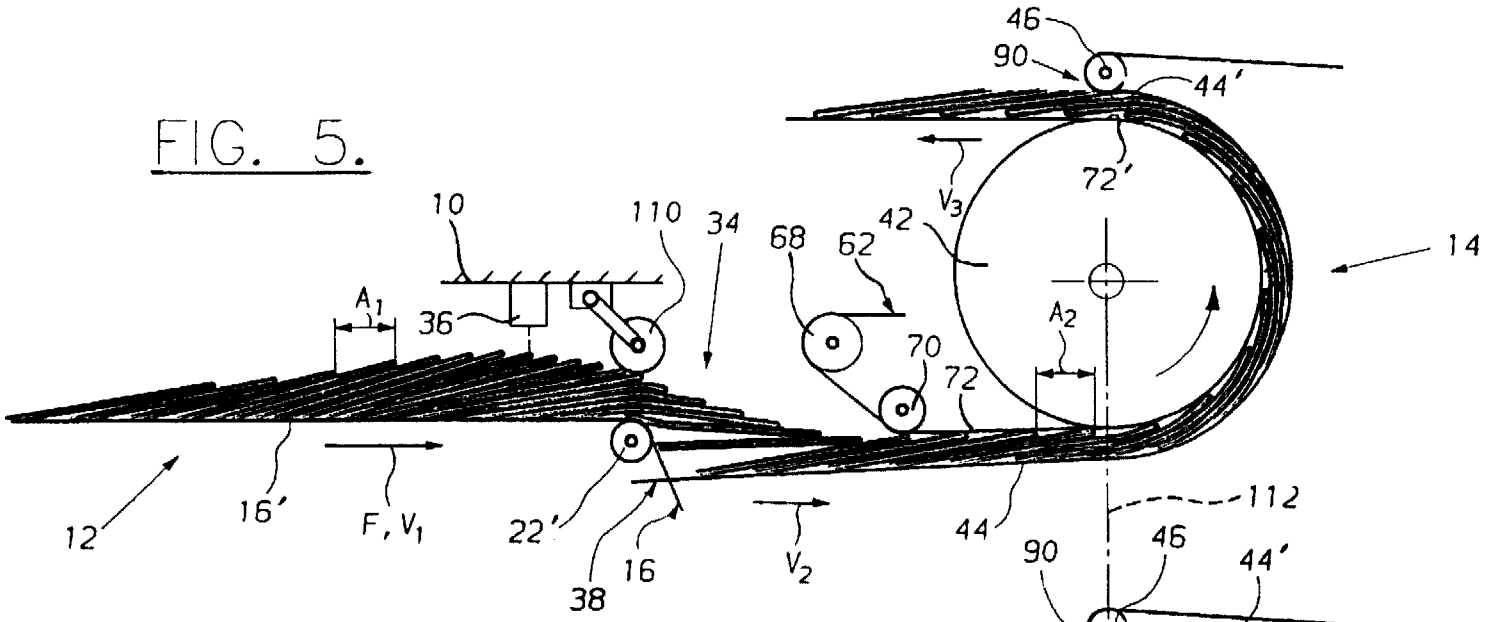
FIGS. 5 and 6 are views similar to FIGS. 3 and 4 showing the apparatus during and after evenly spaced printed products are guided in an imbricated formation, the products being fed, in one section of the formation, in compacted, piled-up form.
Figure 6:
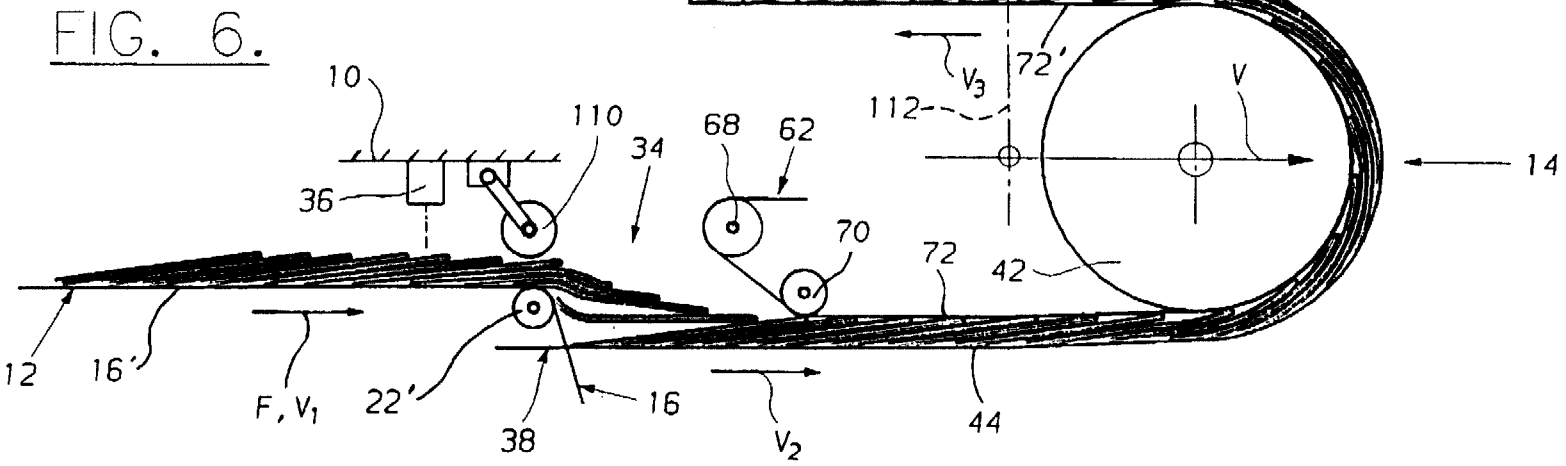

It is also possible, in an imbricated formation S, for the spacing between the leading edges 32' of some products 32 to be smaller than the otherwise normal spacing A1. These products 32 result in a form of piling up and, consequently, in compaction of the imbricated formation S, as is shown in FIG. 5. If the detector arrangement 36 detects too small a spacing between successive products 32, the second conveyor 14 is driven, with a time delay corresponding to the spacing between the detector arrangement 36 and the transfer location 34, at a speed v2 which, in accordance with the excessively small spacing between the leading edges 32' of the fed products 32, is greater than the speed v1. If the speed v3 of the second conveyor 14 at the discharge location 90 remains unchanged during this, the conveying length of the second conveyor 14 increases, which is associated with a movement of the deflection wheel 42 to the right, as is indicated in FIG. 6 by an arrow V. When the first product 32 to follow the pile-up reaches the transfer location 34 with the correct spacing A1, the speed v2 is reduced to the speed v1 again, which is shown in FIG. 6.

Irrespective of the mutual position which the products 32 assume in the region of the first conveyor 12, they are always brought into the desired mutual position with a predetermined spacing A2 upon transfer to the second conveyor 14. The spacing A2 remains unchanged in the region of the second conveyor 14.

The apparatus shown in FIGS. 1 and 2 also makes it possible to form a gap in the imbricated formation S at the discharge location 90 in the event where, for example, a clamp 96 of the removal conveyor 94 is not to be provided with a product 32. A gap of this type is designated in FIG. 1 by L. If a gap L is to be formed, then, as is indicated in FIG. 7, the speed v3 is brought to zero by stopping the second drive motor 76, while the third conveyor 92 continues to run with unchanged speed v4. The products retained in the conveying nip 64 remain there, whereas the last product 32, as seen in the conveying direction F, released from the conveying nip 64 at the second deflection roller 46 is transported further by the third conveyor 92. As soon as the gap L of the desired magnitude is formed, the second drive motor 76 is then driven on, in order to drive the second conveyor 14 at the discharge location 90 at the same speed v3 as the third conveyor 92. If, during the formation of the gap, products 32 are further fed to the second conveyor 14 at the transfer location 34, the conveying length of the second conveyor 14 is increased, which is associated with a movement of the deflection wheel 42 to the right, as shown in FIG. 8 by the straight reference lines 112.

It is conceivable for the second conveyor 14 to be designed as a clamp-type transporter which includes clamps arranged at a predetermined spacing one behind the other on a drawing member. In this arrangement, the drawing member could, in a manner similar to the conveying belt 38 and transporting belt 62, be guided around a deflection wheel which can be changed in position to change the conveying length. It is also conceivable to drive the carrying element 48 and the second conveyor 12 with only one drive motor.

It is not necessary for the products 32 to be fed in an imbricated formation S or for an imbricated formation to be formed at the transfer location 34. It is also possible to feed products individually one behind the other or in the manner of separate piles corresponding to FIG. 5 and then to transfer them into an imbricated formation with constant spacing A2 at the transfer location 34 or to arrange them there in a formation in which the products 32 do not overlap and are arranged at a predetermined spacing one behind the other.

While particular embodiments of the invention have been described, it will be understood, of course, the invention is not limited thereto since modifications may be made by those skilled in the art, particularly in light of the foregoing teachings. It is, therefore, contemplated by the appendant claims to cover any such modifications that incorporate those features of these improvements in the true spirit and scope of the invention.

That which is claimed is:

1. An apparatus for evenly spacing successive sheet-like products comprising:

a first conveyor for feeding products having a spacing between mutually corresponding edges of successive products to a stationary transfer location;

a second conveyor positioned downstream of the first conveyor to receive said products at the transfer location and convey the products to a discharge location, said second conveyor having an adjustable effective conveying length extending from the transfer location to the discharge location;

a detector arrangement positioned upstream of the transfer location for detecting the spacing between the successive products arranged on the first conveyor;

a first motor for driving said second conveyor at an adjustable first predetermined speed at said transfer location wherein said first speed is adjusted dependent upon signals received from the detector arrangement such that the spacing between mutually corresponding edges of successive products corresponds to a predetermined spacing; and a second drive motor for driving said second conveyor at a second predetermined speed at said discharge location wherein the effective length of the second conveyor is adjusted as a function of the first predetermined speed of said second conveyor at the transfer location and the second predetermined speed of the second conveyor at the discharge location.

2. The apparatus as claimed in claim 1 wherein the discharge location is stationary.

3. The apparatus as claimed in claim 1 wherein the second predetermined speed of the second conveyor at the discharge location is adjustable.

4. The apparatus as claimed in claim 1, wherein the second conveyor comprises a movable deflection wheel, an endless conveying belt having a conveying strand and a return strand, said conveying strand being guided between the transfer location and the discharge location and at least partially around the deflection wheel so that the deflection wheel is moved when the effective conveying length is changed, said second conveyor further comprising a length-compensating device about which the return strand is guided.

5. The apparatus as claimed in claim 4, wherein the apparatus further comprises a framework, and wherein the deflection wheel is mounted rotatably on a carrying element which is mounted on the framework such that the carrying element can be moved along an essentially straight movement path; said conveying belt extending to the deflection wheel from a first deflection roller mounted on the framework upstream of the deflection wheel so as to define a conveying direction, said conveying belt extending from said deflection wheel, in a direction opposite the conveying direction, to a second deflection roller mounted on the framework, said conveying belt extending from the second deflection roller to a further deflection roller mounted on the framework and then to said length compensating device, said length-compensating device comprising a deflector roller arrangement mounted on the carrying element.

6. The apparatus as claimed in claim 5, wherein the second conveyor further comprises an endless transporting belt which forms, with the conveying belt, a conveying nip and having an effective strand for the products which extends to the deflection wheel from a first guide roller which is mounted on the framework between the transfer location and the deflection wheel, and further extends around said deflection wheel in contact therewith, and then extends from said deflection wheel to a second guide roller which is mounted on the framework, said endless transporting belt comprising a return strand extending from the second guide roller back to the first guide roller, with the return strand being guided about a further length compensating device which includes at left one further deflection roller mounted on the carrying element.

7. The apparatus as claimed in claim 6 wherein the conveying belt and the transporting belt are connected to one another for entrainment, and, as seen in the conveying direction, the transporting belt is connected to said first motor at a location between the further length-compensating device and the deflection wheel, and to said second motor at a location between the deflection wheel and the further length-compensating device.

8. The apparatus as claimed in claim 4 wherein the discharge location is stationary.

9. The apparatus as claimed in claim 8 wherein the second predetermined speed of the second conveyor at the discharge location is adjustable.

10. The apparatus as claimed in claim 1, further comprising a third conveyor positioned downstream of the second conveyor so as to receive the products at the discharge location, and a drive for driving the third conveyor at a third predetermined speed.

* * * * *